US007062843B1

(12) United States Patent
Lin

(10) Patent No.: US 7,062,843 B1
(45) Date of Patent: Jun. 20, 2006

(54) STRAIGHT TYPE RIVETING GUN

(76) Inventor: Yu-Ching Lin, 1F, No. 159, Sec. 2, Da-Tong Road, Sijhih City, Taipei Hsien (TW)

( * ) Notice: Subject to any disclaimer, the term of this patent is extended or adjusted under 35 U.S.C. 154(b) by 0 days.

(21) Appl. No.: 11/056,228

(22) Filed: Feb. 14, 2005

(51) Int. Cl.
*B23Q 15/00* (2006.01)
*B21J 15/28* (2006.01)

(52) U.S. Cl. ..... 29/715; 29/243.525; 72/391.4

(58) Field of Classification Search ..... 29/715, 29/243.521, 243.523, 243.524, 243.525, 29/243.53, 524.1, 525.06; 72/391.4, 391.6
See application file for complete search history.

(56) References Cited

U.S. PATENT DOCUMENTS 3,164,283 A * 1/1965 Olson ..... 29/243.523
3,523,441 A * 8/1970 Kurc ..... 29/243.523
3,528,277 A * 9/1970 Perkins ..... 29/243.523
3,898,833 A * 8/1975 Richardson ..... 29/243.525
4,259,858 A * 4/1981 Freeman et al. ..... 29/243.523
4,630,460 A * 12/1986 Mauer ..... 29/243.525
4,866,972 A * 9/1989 Schwab ..... 29/243.523
6,418,599 B1 * 7/2002 Suzuki et al. ..... 29/243.523

* cited by examiner

*Primary Examiner*—David P. Bryant
(74) *Attorney, Agent, or Firm*—Troxell Law Office, PLLC

(57) ABSTRACT

The present invention relates to a straight type riveting gun, which comprises a gun body having a pipe body and a tube body, a front gun pipe, and a back cover, wherein the front gun pipe is locked to front end of the pipe body and the back cover is locked to the tail end of the tube body. The tube body is provided for receiving a rivet-ejecting adaptor of an oil pressure rod. A trigger is mounted at the tail end of the pipe body for pushing a trigger ejector rod. The trigger ejector rod moves a valve to allow the exterior gas to enter a gas-collecting room for forcing a pneumatic piston to perform movement by use of air pressure. The oil pressure rod pushes the oil liquid to allow the riveting rod to generate powerful pulling force instantaneously thereby completing the riveting operation.

2 Claims, 8 Drawing Sheets

STRAIGHT TYPE RIVETING GUN

FIELD OF THE INVENTION

The present invention relates to a straight type riveting gun, and more particularly to a riveting gun structure, which performs the riveting operation by pneumatic oil pressure, and which triggers the liquid pressure by air pressure to backwardly move the pneumatic piston for performing the riveting operation. By use of the handle and the intake terminal that align the same line, the straight type riveting gun of the present invention may be applied to various working conditions.

BACKGROUND OF THE INVENTION

The riveting gun is a specialized manual tool for industry and decoration. In the conventional riveting gun, the handle and the riveting device are intersected with one another. Therefore, it is primarily employed to rivet two parallel boards. However, for the riveting gun, which is operated in the vertical direction, the riveting operation is limited by the intersected structure of the riveting device and the handle. The riveting operation of the riveting gun in vertical direction is not smooth and does not comply with ergonomics. Accordingly, the pneumatic hydraulic riveting gun is not suitable for the riveting operation in vertical direction.

Moreover, the pushing device of the conventional riveting gun is mounted outside the gun body. In other words, when a trigger is pressed, a connecting rod triggers a hitting board so as to move a piston-pushing rod for controlling the gas flow. Because the devices are exposed to the outside, the connecting rod easily gets loose or suffers from damage due to collision. Besides, the conventional riveting gun lacks the beautiful appearance.

Furthermore, the rivet-ejecting method of the conventional riveting gun is accomplished by downwardly inclining the riveting hole or the backseat of the riveting gun so as to allow the rivet to fall down as a result of rivet's weight. According to this operation method for ejecting the rivet, the operator must change the angle of the riveting gun unceasingly. Moreover, the required time for free falling of the rivet is very long and further affects the speed of the riveting operation.

SUMMARY OF THE INVENTION

In view of the drawbacks of the conventional riveting gun, the present inventor discloses a straight type riveting gun in accordance with his several years working experience and the technologic theory and provides the industry with this straight type riveting gun.

The main object of the present invention is to provide a straight type riveting gun. By means of its straight design, it may be applied to a location where the operation needs to be performed in vertical direction. Moreover, the straight type riveting gun may be hung by use of the hanging hole that forms on its end so as to help to take it out and facilitate its operation.

Another object of the present invention is to embed the interactive connecting rod of the straight type riveting gun in the machine body of the riveting gun. A trigger on the outside of the machine body actuates the riveting gun. The hidden connecting rod beautifies the outward appearance of the machine body and prevents from damage caused by unexpected collision.

The still another object of the present invention is to provide a straight type riveting gun for automatically ejecting a rivet through pneumatic action, which sucks the rivet before operation and ejects the rivet after operation so as to achieve the purposes of rapid operation and easy use.

The other features and preferred embodiments of the present invention will now be described with reference to the accompanying drawings.

DETAILED DESCRIPTION OF THE PREFERRED EMBODIMENT

Figure 1:
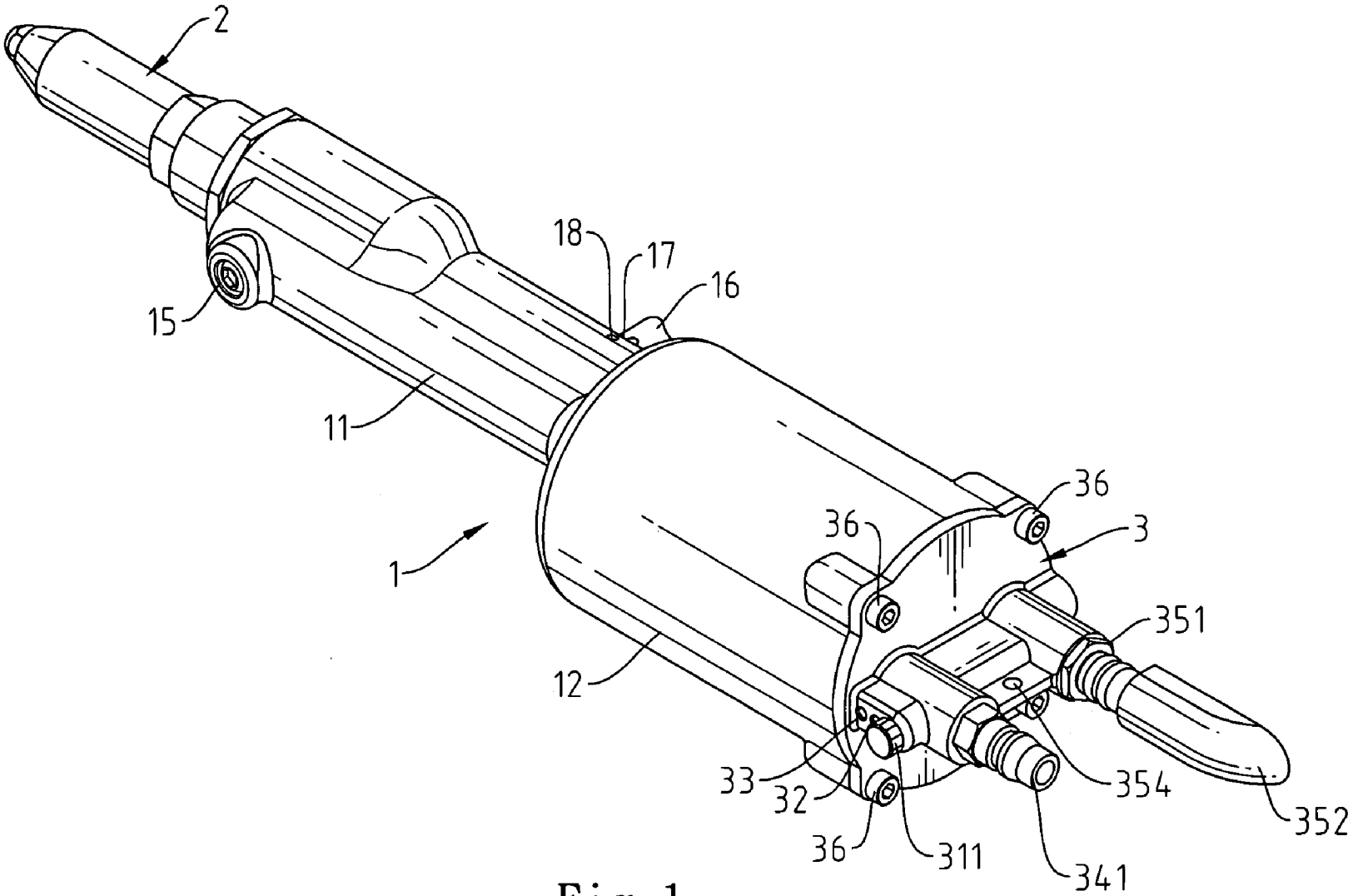
FIG. 1 is an elevational view showing outward appearance of the present invention.
Figure 2:
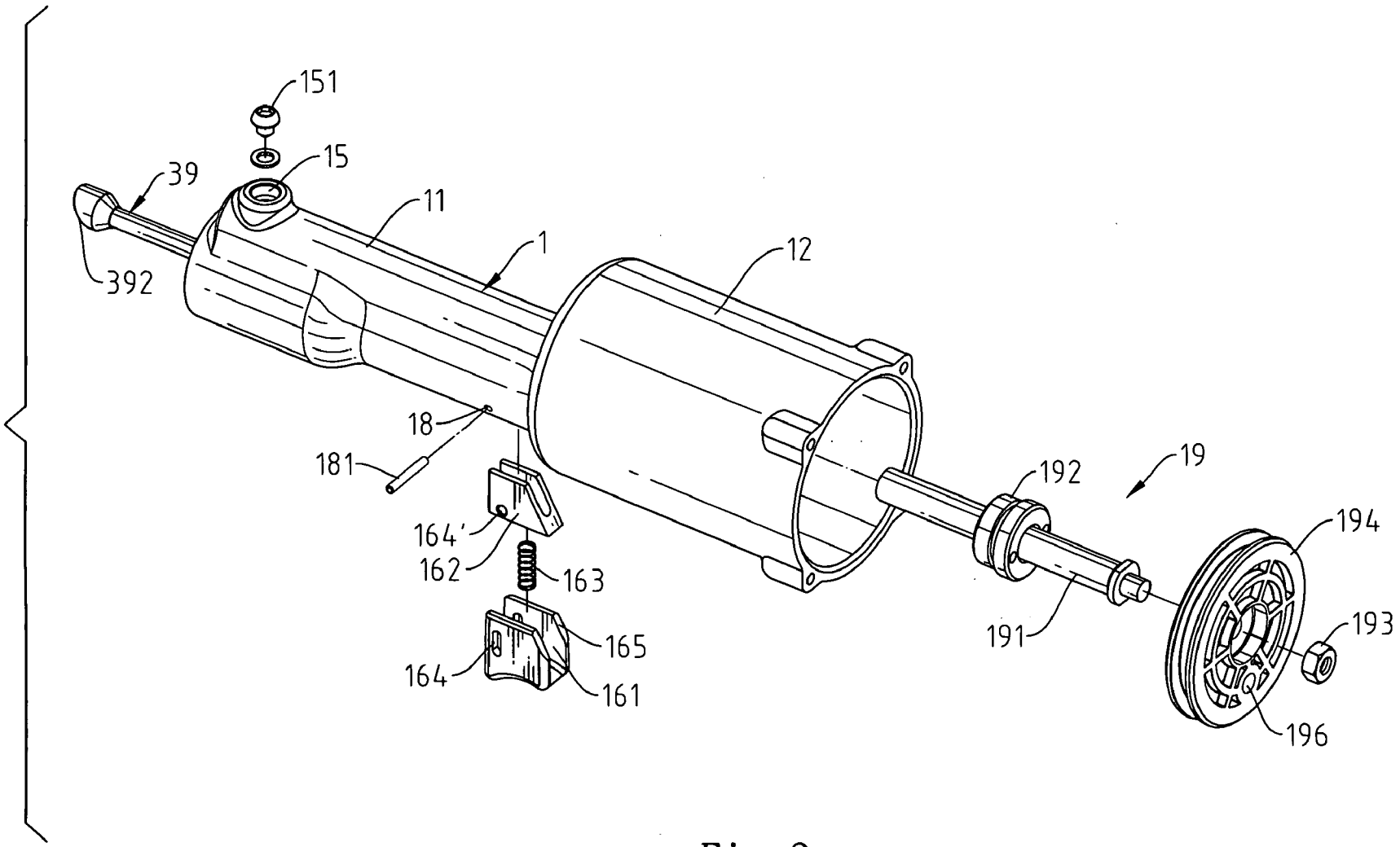
FIG. 2 is a partial exploded, elevational view showing the gun body of the present invention.
Figure 3:
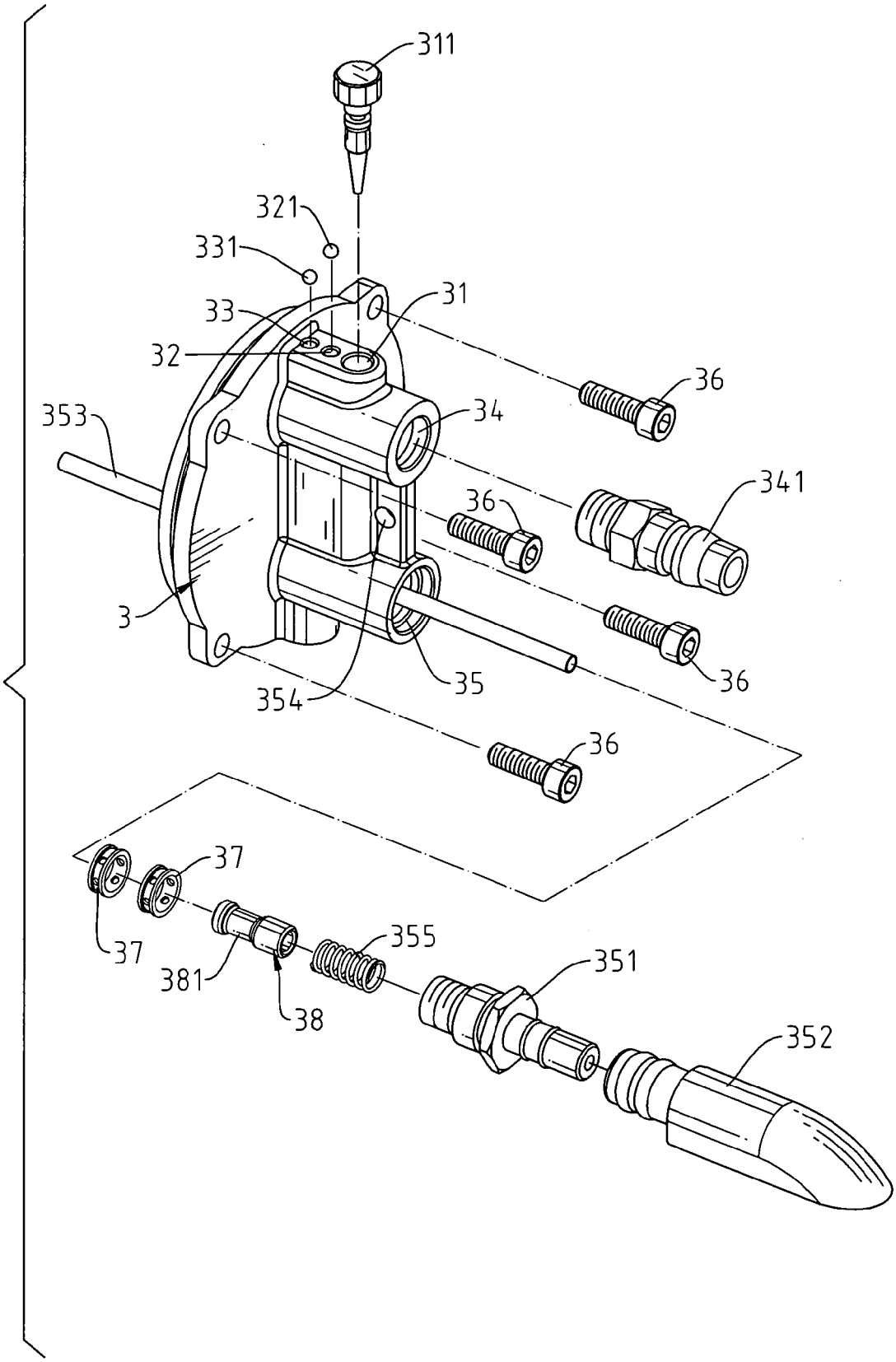
FIG. 3 is a partial exploded, elevational view showing the back cover of the present invention.
Figure 4:
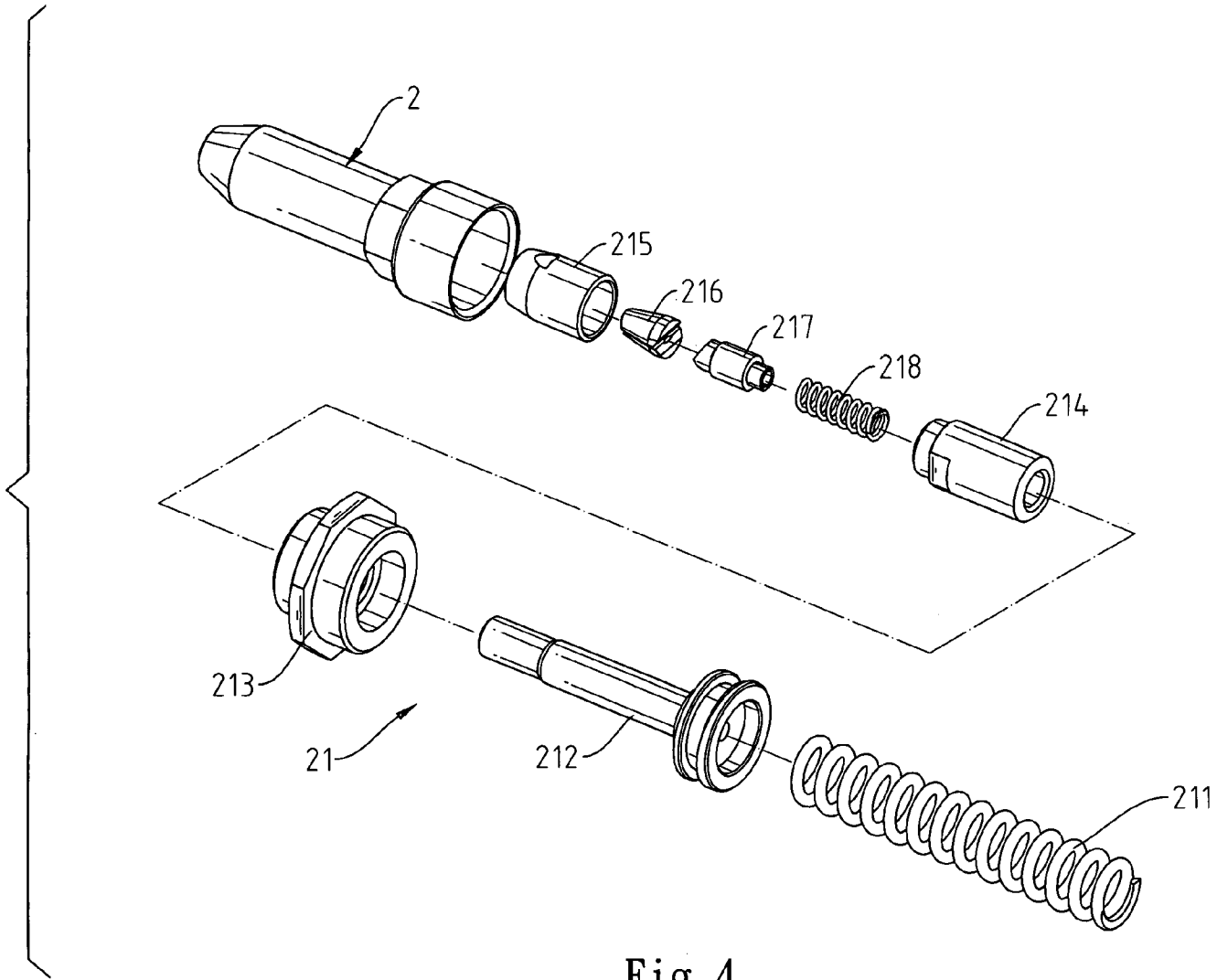
FIG. 4 is a partial exploded, elevational view showing the front gun pipe of the present invention.
Figure 5:
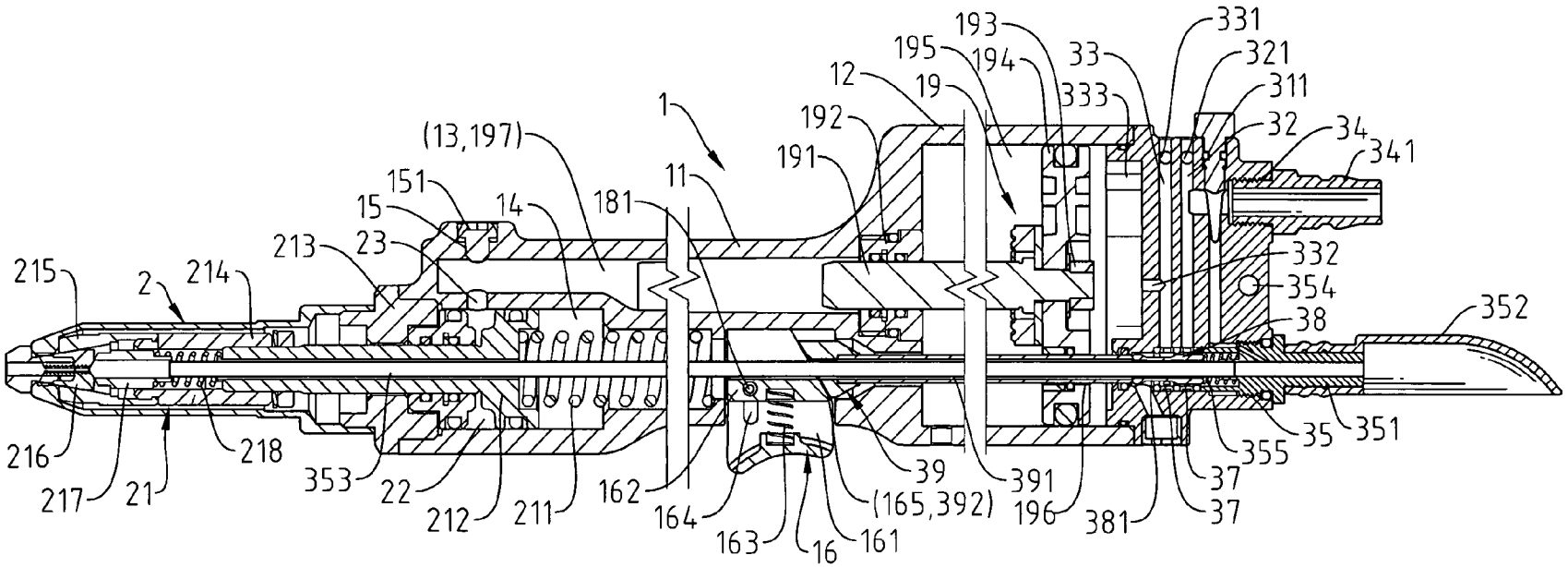
FIG. 5 is a cross-sectional view showing interior structure of the present invention.
Figure 6:
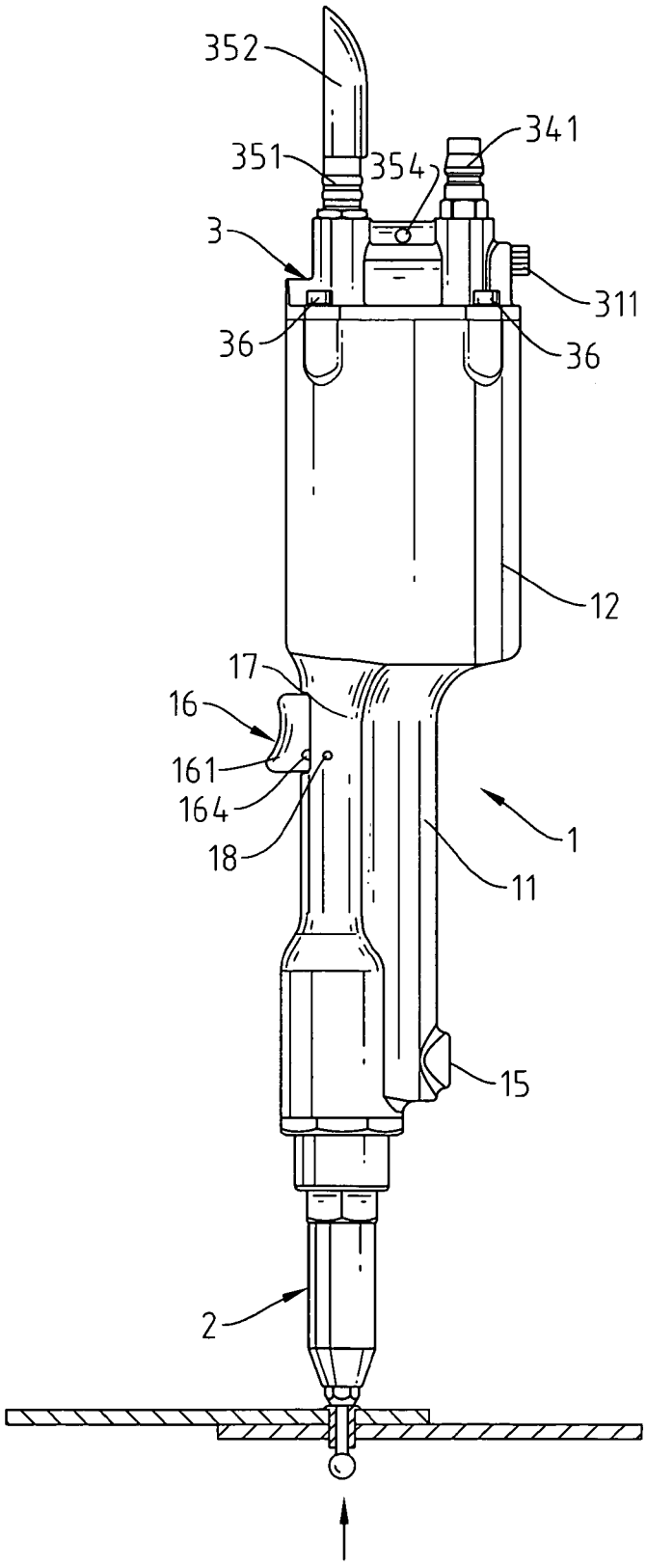
FIG. 6 is a plan view showing a preferred embodiment of the present invention.

In order to achieve the aforementioned objects, the present inventor discloses a straight type riveting gun. The detailed structural feature and the preferred embodiment of the present invention will now be described in detail with reference to the accompanying drawings.

Referring to FIG. 1 through FIG. 6, the straight type riveting gun of the present invention comprises a gun body 1, a front gun pipe 2, and a back cover 3. The gun body 1 is composed of a pipe body 11 and a tube body 12, wherein the front gun pipe 2 is locked to a front end of the pipe body 11 and locking devices 36 are locked to a tail end of the tube body 12. The inside of the tube body 11 is divided into an upper tunnel 13 and a lower tunnel 14 and communicated with the tube body 12. An oil-filling hole 15 is formed at the front end of the pipe body 11. Moreover, a bolt 151 is utilized to open or close the oil-filling hole 15, and a trigger hole 17 for receiving a trigger 16 is formed at a tail end of the pipe body 11. The trigger 16 is composed of a pushing member 161 and an actuating member 162 and a spring 163 coupled therebetween. The pushing member 161 includes a bevel edge 165 at one end thereof. The pushing member 161 and the actuating member 162 respectively include two matched position holes 164, 164' on both sides thereof. The trigger 16 is fixed to the trigger hole 17 by use of a plug 181 that penetrates through the position holes 164, 164' and into a fixing hole 18 on one side of the trigger hole 17.

An oil pressure rod 19 is composed of a cylinder rod 191, a seating ring 192, which sleeves a front end of a cylinder rod 191, and a pneumatic piston 194, which locks to the cylinder rod 191 by a screw 193, and a through hole 196 is formed on a proper intermediate position of the pneumatic piston 194. By mounting the oil pressure rod 19 inside the tube body 12, the pneumatic piston 194 exactly plugs up the interior margin of tube body 12 and the seating ring 192 exactly plugs up the upper tunnel 13 so as to make the tube body 12 form a sealed air pressure chamber 195 and make the upper tunnel 13 form an oil pressure chamber 197.

The back cover 3 includes a first notch 31, a second notch 32, and a third notch 33 at its radial end, and a first shaft hole 34, a second shaft hole 35, and a hanging hole 354 on one side of its axial end, wherein one end of the first shaft hole 34 is screwed to an intake adapter 341 and the other end of the first shaft hole 34 extends and communicates with the first notch 31 and the second notch 32. Moreover, one end of the second shaft hole 35 screws to a rivet-ejecting adaptor 351 and the other end of the second shaft hole 35 penetrates through the back cover 3 axially to couple with the through hole 196 of the pneumatic piston 194. Furthermore, a throttle 311 is mounted on the top of the first notch 31, and gas check devices 321, 331 are embedded respectively in the top of the second notch 32 and the third notch 33. An intake ring 37 is mounted at the bottom end of the second shaft hole 35 in two respective positions where second shaft hole 35 intersects the second notch 32 and the third notch 33. Besides, the intake ring 37 is designed for receiving a sleeve-shaped valve 38 that penetrates thereof. A trigger ejector rod 39 leans against one side of valve 38 where a trench 381 surrounds. If the trigger 16 is pushed, the pushing member 161 will move the trigger ejector rod 39 to cause the valve 38, which is leant by the trigger ejector rod 39, to shift to both sides by use of a bevel edge 392, which is located on another side of the trigger ejector rod 39 and is corresponding with the bevel edge 165 of the pushing member 161 of the trigger 16. The back cover 3 includes a shaft hole 332 on its other side for communicating with the third notch 33. When the back cover 3 locks to the tail end of the tube body, a gas-collecting room 333 is formed therebetween. Besides, the above-mentioned first shaft hole 34 utilizes the intake adapter 341 to communicate with the exterior atmosphere and makes the gas reach the first notch 31 and the second notch 32 via the first shaft hole 34. The throttle 311 on the top of the first notch 31 is used for controlling a flow rate of the gas that flows through the intake adaptor 341. A tail sleeve 352 is mounted at one end of the rivet-ejecting adaptor 351. A rivet-ejecting pipe 353 and a spring 355 are connected to the other end of the rivet-ejecting adaptor 351. The first notch 31 is located to communicate with the second shaft hole 35 to make the gas flow that flows to the second shaft hole 35 produce always-on suction force so as to suck a rivet before performing operation. Moreover, the rivet-ejecting pipe 353 is received in a through hole 391 of the trigger ejector rod 39 and stretched to the front gun pipe 2 so as to facilitate ejection of invalid rivet after finishing the operation.

Furthermore, the above-mentioned front gun pipe 2 is screwed to the opening of the lower tunnel 14 that forms on the front end of the pipe body 11, wherein the lower tunnel 14 is designed for receiving a riveting rod 21. The riveting rod 21 is connected to the trigger 16 through a recoverable spring 211, wherein a guide rod 212 inserts into a connecting ring 213 and screws to a rear conduit part 214, and a dual-claw 216 mounts inside a front conduit part 215 to connect with an expansion bolt 217 and a spring 218 and to screw to the rear conduit part 214. Moreover, a gap 22 is formed between the guide rod 212 and the connecting ring 213 such that the pushing pressure generated by the oil pressure rod 19 allows the oil liquid inside the upper tunnel 13 to enter the gap 22 via a communication hole 23 for forming a pushing force required for the riveting operation.

Figure 7:
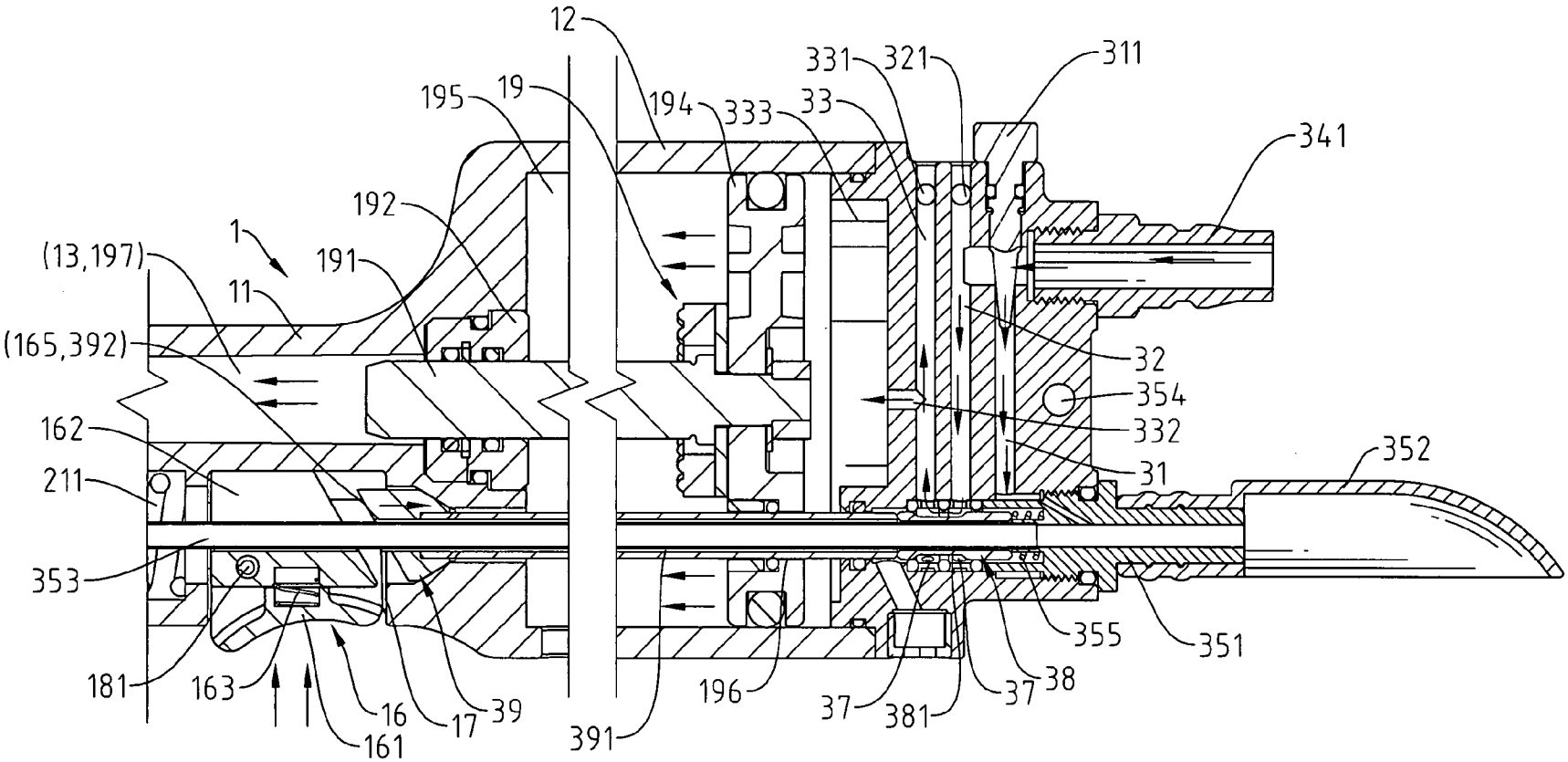
FIG. 7 is a schematic, cross-sectional view showing the riveting status of the preferred embodiment of the present invention.

Referring to FIG. 1 through FIG. 8, when the riveting operation is proceeding, as shown in FIG. 7, the trigger 16 is pressed to allow the pushing member 161 to push the trigger ejector rod 39 toward the right side and to allow the trigger ejector rod 39 to push the valve 38 toward the right side, thereby moving the trench 381 of the valve 38 to a position under the second notch 32 and the third notch 33. Accordingly, the gas flowed through the second notch 32 communicates with the third notch 33 via the trench 381 of the valve 38. The gas flow of the third notch 33 enters the gas-collecting room 333 via the shaft hole 332. The air pressure inside the gas-collecting room 33 forces the pneumatic piston 194 to shift its position and the oil pressure rod 19 pushes the front end of the upper tunnel 13 simultaneously. Because the upper tunnel 13 fills with oil liquid, the oil liquid enters the lower tunnel 14 continuously via the communication hole 23 and forms oil pressure between the guide rod 212 of the lower tunnel 14 and the connecting ring 213. The oil pressure forces the riveting rod 21 to shift toward the tail end of the riveting gun instantaneously thereby completing the riveting operation and bringing the riveting rod 21 back to its original position by means of the recoverable spring 211.

Figure 8:
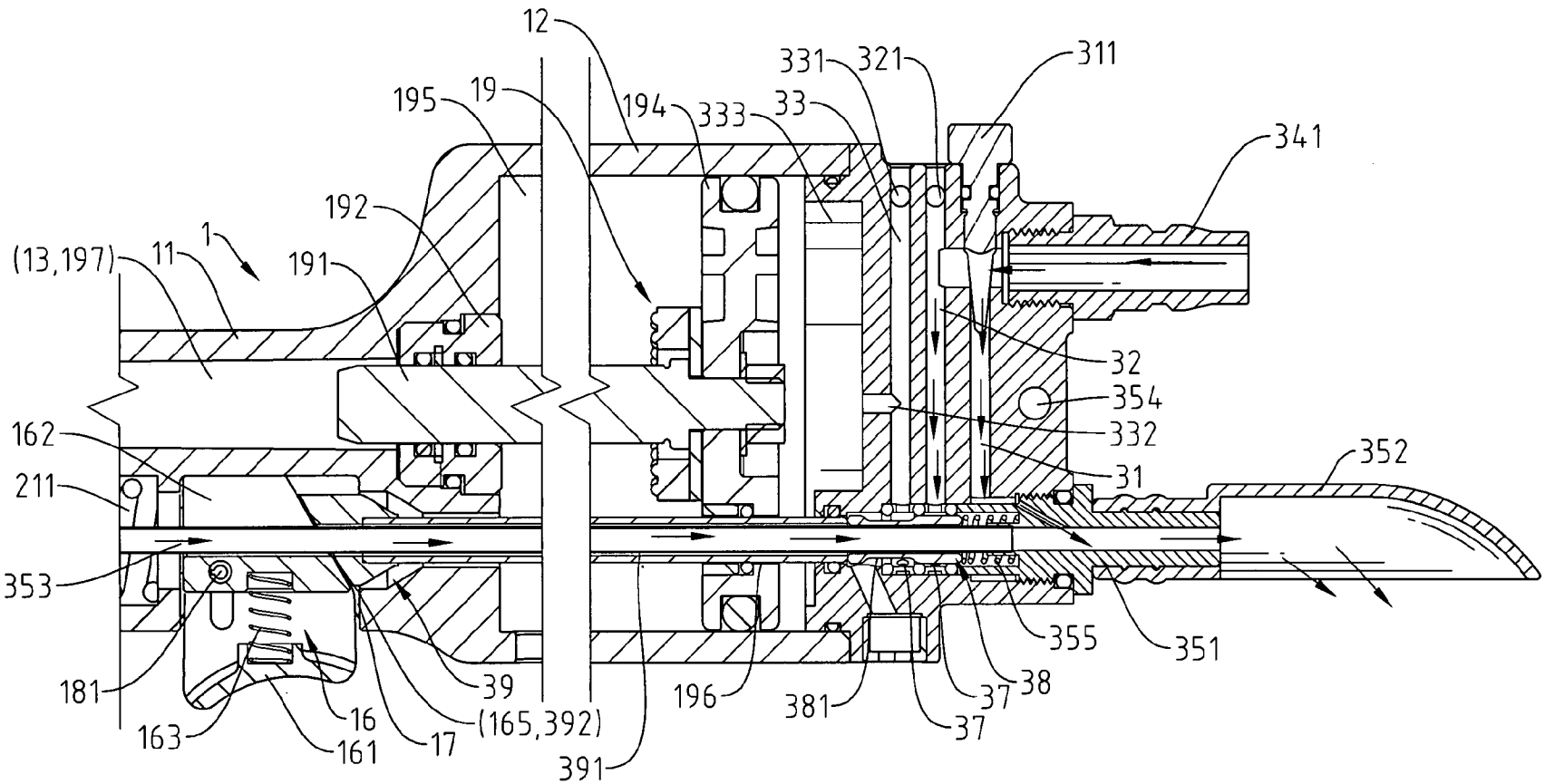
FIG. 8 is a schematic, cross-sectional view showing the rivet-ejecting status and the non-active status of the preferred embodiment of the present invention.

When the trigger is released, as shown in FIG. 8, the valve 38 returns to its original position to close the communication between the second notch 32 and the third notch 33 by use of the trench of the valve 38. The first notch 31 is located to communicate with the rivet-ejecting pipe 353 to make the gas flow that flows to the rivet-ejecting pipe 353 produce always-on suction force. The throttle 311 is used for controlling the flow rate of the gas that flows through the intake adaptor 341 such that the remaining riveting is delivered directly to the tail sleeve 352 having cushioning and operator protection effects via the channel of the rivet-ejecting pipe 353 so as to eject the rivet from the riveting gun after finishing the riveting operation.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

What is claimed is:

1. A straight type riveting gun comprising a gun body consisting of a pipe body and a tube body, a front gun pipe, and a back cover, wherein the front gun pipe is locked to a front end of the pipe body and the back cover is locked to a tail end of the tube body, characterized in that:

the inside of the pipe body is divided into an upper tunnel and a lower tunnel for communicating with the tube body, an oil-filling hole being formed at an exterior radial end on one side of the pipe body, a trigger having a bevel edge being mounted on the other side of the pipe body, the lower tunnel being provided for receiving a trigger ejector rod, a rivet-ejecting pipe being received by a through hole of the trigger ejector rod and extended to the front gun pipe, the trigger ejector rod having a bevel edge at one end thereof to correspond with the bevel edge of the trigger and the other end thereof being extended to the tube body;

the tube body is provided for receiving an oil pressure rod, the oil pressure rod comprising a pneumatic piston plugged up the tube body to form a sealed air pressure chamber and a seating ring plugged up the upper tunnel to form an oil pressure chamber;

the back cover having a first notch, a second notch, and a third notch at its radial end, a first shaft hole and a second shaft hole on one side of its axial end, and a third shaft hole on the other side to communicate with the third notch, one end of the first shaft hole being screwed to an intake adapter, the other end of the first shaft hole being extended and communicated with the first notch and the second notch, one end of the second shaft hole being screwed to a rivet-ejecting adaptor and the back cover being penetrated axially by the other end of the second shaft hole, the second shaft hole being communicated with the first notch, an intake ring for receiving a sleeve-shaped valve being mounted at each end of the second notch and the third notch in two respective positions where the second shaft hole intersects the second notch and the third notch, the trigger ejector rod being leant against one side of valve where a trench surrounds, the back cover being locked to the end of the tube body so as to form a gas-collecting room between them;

the gas flows into the above-defined structure from the intake adaptor and reaches the second shaft hole to produce always-on suction force so as to suck a rivet before performing operation; and the trigger is pressed to push and move the trigger ejector rod toward the tail end of the tube body and to allow the trigger ejector rod to push and move the valve toward an opposing direction thereby: moving the trench of the valve to a position under the second notch and the third notch so as to allow the gas flow flowed through the second notch to communicate with the third notch via the trench of the valve and the gas flow of the third notch to enter the gas-collecting room via the shaft hole, the gas flow inside the gas-collecting room forms air pressure to force the pneumatic piston that connects to the pneumatic piston to move toward the front end of the upper tunnel that fills with oil liquid to form oil pressure, wherein the oil pressure forces the riveting rod to shift instantaneously thereby completing the riveting operation and ejecting the rivet through the rivet-ejecting pipe.

2. The straight type riveting gun of claim 1, wherein a hanging hole is formed on the back cover.

* * * * *